US010279598B2

(12) United States Patent
Deppe

(10) Patent No.: US 10,279,598 B2
(45) Date of Patent: May 7, 2019

(54) LASER PRINTING SYSTEM

(71) Applicant: KONINKLIJKE PHILIPS N.V., Eindhoven (NL)

(72) Inventor: Carsten Deppe, Aachen (DE)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 15/742,547

(22) PCT Filed: Jul. 22, 2016

(86) PCT No.: PCT/EP2016/067513
§ 371 (c)(1),
(2) Date: Jan. 8, 2018

(87) PCT Pub. No.: WO2017/013242
PCT Pub. Date: Jan. 26, 2017

(65) Prior Publication Data

US 2018/0201028 A1 Jul. 19, 2018

(30) Foreign Application Priority Data

Jul. 23, 2015 (EP) ..... 15178084

(51) Int. Cl.
*B41J 2/45* (2006.01)
*B41J 2/447* (2006.01)

(52) U.S. Cl.
CPC ..... *B41J 2/45* (2013.01); *B41J 2/447* (2013.01)

(58) Field of Classification Search
CPC .... B41J 2/45; B41J 2/455; B41J 2/447; B29C 64/00
See application file for complete search history.

(56) References Cited

U.S. PATENT DOCUMENTS 5,325,383 A 6/1994 Davis et al.
5,352,405 A 10/1994 Beaman et al.
(Continued)

FOREIGN PATENT DOCUMENTS

GB 2422344 A 7/2006
WO 2011114296 A1 9/2011
WO 2015091459 A1 6/2015

OTHER PUBLICATIONS

Niesler et al "Lasers for 3D Printing: Additive Manufacturing With NIR Lasers Forms Microsized Parts" Laser Focus World, Aug. 6, 2014.

*Primary Examiner* — Julian D Huffman
*Assistant Examiner* — Michael T Konczal

(57) ABSTRACT

The invention describes a laser printing system (100) for illuminating an object (70) in a working plane (80). The object (70) moves relative to a print head (50) of the laser printing system (100). The print head (50) comprises a total number of laser modules (150), each laser module (150) comprises at least one laser array (110) of lasers (115). At least two of the laser modules (150) share an electrical power supply (20). The laser printing system (100) further comprises a controller (10) being adapted such that at maximum processing speed of the print head (50) only a predefined number of laser modules (150) can be driven at nominal electrical power, wherein the predefined number of laser modules (150) is smaller than the total number of laser modules. The invention further relates to a corresponding method of laser printing. The laser printing system and the method allow designing the laser printing system for, for example, only 20% of the total power which would be required to drive all lasers at nominal electrical power while having only slightly reduced processing speed.

20 Claims, 11 Drawing Sheets

(56) References Cited

U.S. PATENT DOCUMENTS

| | | | | |
|---|---|---|---|---|
| 5,517,231 | A | 5/1996 | Sarraf | |
| 6,151,345 | A | 11/2000 | Gray | |
| 2003/0028278 | A1 | 2/2003 | Darrah et al. | |
| 2003/0052105 | A1 | 3/2003 | Nagano et al. | |
| 2008/0111271 | A1 | 5/2008 | Khoshnevis | |
| 2011/0216794 | A1* | 9/2011 | Howard | B82Y 20/00 372/38.01 |
| 2013/0216836 | A1 | 8/2013 | Grebe et al. | |
| 2014/0139607 | A1* | 5/2014 | Hayashi | B41J 2/45 347/224 |

* cited by examiner

LASER PRINTING SYSTEM

CROSS-REFERENCE TO PRIOR APPLICATIONS

This application is the U.S. National Phase application under 35 U.S.C. § 371 of International Application No. PCT/EP2016/067513, filed on Jul. 22, 2016, which claims the benefit of EP Patent Application No. EP 15178084.8, filed on Jul. 23, 2015. These applications are hereby incorporated by reference herein.

FIELD OF THE INVENTION

The invention relates to a laser printing system and a method of laser printing. Laser printing refers to printing of documents, thermal threating or printing of conductive tracks (printed electronics) as well as 3D printing by means of lasers for additive manufacturing, for example, used for rapid prototyping (selective laser melting or selective laser sintering and the like).

BACKGROUND OF THE INVENTION

Conventional laser printing systems as laser printers and selective-laser melting machines consist of a single high-power laser and a scanner to scan the laser over the area to be illuminated. To increase the processing speed, it is desirable to have a printing head with several independent channels i.e. an addressable array of lasers covering a significant part of the area. Preferably, the printing head covers the full width of the area to be printed with one addressable laser source per pixel, so that the print head needs to be moved only in one direction. The requirements regarding the electrical power which has to be provided depend on the width of the printing head, number and power of the laser sources per pixel and the structure which has to be printed. In extreme cases several kilowatt of electrical power at several thousand Ampere of electrical current have to be provided if a close surface has to be processed.

US 2014/0139607 A1 discloses an optical writing device is configured to form electrostatic latent images on a plurality of photosensitive elements by a plurality of light sources. The optical writing device includes: an image-data acquiring section that acquires image data; and a light-source control section that performs light-emission control on the light source based on pixel data generated from acquired image data, and also performs a neutralization process on the photosensitive element by controlling the light source to expose the photosensitive element to light. In the neutralization process, the light-source control section divides a period during which light-on/off control can be performed on the light source, into sub-periods based on pixel data input to the light-source control section, and causes the light sources to be lit in any one of the sub-periods so as to always place at least one of the plurality of light sources in a light-off state.

WO 2011/114296 A1 discloses a laser based printing apparatus using laser light sources for supplying energy to a target object to form an image, comprising a laser light source arrangement comprising a plurality of laser light sources, a transport mechanism and a controlling arrangement connected to the laser light arrangement and the transport mechanism.

WO 2015/091459 A1 discloses a laser printing system for illuminating an object moving relative to a laser module of the laser printing system in a working plane is provided. The laser module comprises at least two laser arrays of semiconductor lasers and at least one optical element. The optical element is adapted to image laser light emitted by the laser arrays, such that laser light of semiconductor lasers of one laser array is imaged to one pixel in a working plane of the laser printing system and an area element of the pixel is illuminated by means of at least two semiconductor lasers.

SUMMARY OF THE INVENTION

It is an object of the present invention to provide an improved laser printing system and a corresponding method of laser printing.

According to a first aspect a laser printing system for illuminating an object in a working plane is provided. The object moves relative to a print head of the laser printing system. Usually the print head moves linearly across the object along one predefined axis. The print head comprises a total number of laser modules. Each laser module comprises at least one laser array of lasers, wherein at least two of the laser modules share an electrical power supply. The lasers are preferably highly integrated lasers such as semiconductor lasers as, for example, Vertical Cavity Surface Emitting Laser (VCSEL). Alternatively, optical pumped lasers or side emitters may be used. The laser printing system further comprises a controller being adapted such that at maximum processing speed of the print head only a predefined number of laser modules can be driven at nominal electrical power wherein the predefined number of laser modules is smaller than the total number of laser modules.

Typical size of the working area which is a part of the working plane of a laser printing system as, for example, a 3D printer is 500 mm wide. Resolution required to print a three dimensional object with acceptable quality is about 0.1 mm pixel size. This means the print head may comprise around 5000 individual Vertical Cavity Surface Emitting Laser (VCSEL) diodes. To achieve the goal of sufficiently fast manufacturing speed the print head has preferably to move with a velocity of at least 300 mm/s. To have sufficient energy for melting the material, for example, 1.5 W optical output power is required for each pixel or VCSEL diode. The input power to get this optical output power is calculated by taking into account the VCSEL efficiency (20 . . . 50%), optical efficiency (95%) and the power supply efficiency (50 . . . 90%). Due to additional requirements of pixel density, fast control and small volume for the complete line the total efficiency from 24 Vdc rail to laser output is only about 14%. With a total of 5000 pixels this means the machine has an installed electrical power of 53.6 kW. Using a 24 Vdc rail the total current at full power is 2230 A.

Given the typical printing shapes this total power is most of the time only a maximum of 10 . . . 20% used, thus reducing the normal power demand to about 10 kW/450 A. Still there are some shapes and situations where all pixels have to be used at the same time, e.g. when printing complete solid layers in an object. For a limited time it is thus required to provide maximum 53.6 kW. The electrical installation has to be adapted to this peak requirement in order to enable printing with maximum velocity. It is therefore proposed to limit the electrical power which can be supplied to the semiconductor lasers or laser arrays to less than 50%, preferably less than 30% and most preferably less than 20% of the electrical power which is required to drive all semiconductor lasers or laser arrays at nominal electrical power at maximum processing speed if the limited time exceeds a predefined threshold value. The nominal electrical power can, for example, be the electrical input power which can be supplied to the semiconductor lasers without causing accelerated degradation of the lasers or laser arrays, or the electrical input power at which the semiconductor lasers are most efficient, or the maximal power which the electronic driver for a defined number of pixels can provide continuously, or the power required for full processing speed. The nominal electrical power may, for example, be specified by manufactures of the lasers or laser arrays. Taking the example given above the electrical input power which can be supplied by the power supply or power supplies is limited such that in case of 20% only 1000 VCSEL can emit an optical power of 1.5 W in order to enable laser sintering at maximum processing speed of 300 mm/s. The optical power of 1.5 W is only an example and may depend on the material which is melted or sintered and the maximum processing speed which may be slower or faster as the given example of 300 mm/s. One laser may be imaged to one pixel in the working plane by means of corresponding optical arrangement (lenses and the like). Each laser may be controlled independently from the other lasers.

Alternatively, it may also be possible to image a group of lasers (e.g. laser array) to one pixel in order to smooth the optical energy which is emitted to and received in the working plane. Combined emission of several lasers to one pixel may avoid printing errors which may be caused, for example, by a malfunction of one laser (the optical energy decreases depending on the ratio between total number of lasers emitted to one pixel on the surface of the object and the number of failing VCSEL. The laser printing system is in this cased adapted to image laser light emitted by a laser arrays such that laser light of semiconductor lasers of at least one laser array is emitted to one pixel in the working plane of the laser printing system. Laser array means any group of lasers especially semiconductor lasers which are arranged in a one or two dimensional arrangement.

Each laser module may comprise one, two, three or more laser arrays. At least two of the laser modules share one electrical power supply. There may be one, two, three or more groups of laser modules each group of laser modules sharing one electrical power supply. In an extreme case all laser modules of the laser printing system have one common electrical power supply. The controller may comprise sub-controllers wherein a first sub-controller may be adapted to control velocity or speed of the print head and a second sub-controller may be adapted to control the electrical power provided to the laser modules, to the laser arrays or to each individual laser. Control of the electrical power comprises control of distribution of the electrical power to the laser arrays or lasers. There may be controllers or sub-controllers controlling power supply to the different groups of laser modules which share one power supply. Alternatively or in addition there may be a master controller controlling power supply to all groups of laser modules. The master controller may control optical power emitted by each single laser. Alternatively, the master controller may only monitor the electrical power needed to emit sufficient optical power at a given processing speed and adapt the processing speed if the electrical power would exceed the maximum power which can be provided to the laser modules at the actual processing speed. The information related to the adapted processing speed may be submitted to sub-controllers being adapted to distribute the electrical power to the laser modules of the lasers respectively such that printing errors are avoided. Printing errors are, for example, irregularities in the printing pattern in the working plane.

The controller of the laser printing system is thus preferably be adapted to reduce a processing speed of the print head if the optical energy to be provided to the object within a predefined time period requires an electrical input power exceeding the nominal electrical power of the laser modules times the predefined number of laser modules. The processing speed or the reduced processing speed may in this case be lower than the maximum processing speed. The controller may be adapted to reduce an electrical input power supplied to the laser modules below the nominal electrical power of the laser modules when the processing speed is lower than the maximum processing speed. The reduction of the processing speed enables emission of laser light by means of more than the predefined number of laser modules at the same time such that a seamless printing may be enabled. Each of the activated laser modules or lasers is supplied with less than the nominal electrical power in order to avoid that the electrical input power supplied to the laser modules exceeds a power threshold which may be defined by the nominal electrical power of the laser modules times the predefined number of laser modules. The relation between the reduction of the processing speed and the reduction of the electrical input power may be linear. Non-linear effects which may be caused by the material properties (thermal conductivity, particle size particle shape et cetera) of the material to be sintered in the working plane can be taken into account by means of accordingly adapted corrections.

The controller may preferably be adapted to control the laser modules with shifted pulse width modulation, wherein the pulse width modulation (PWM) is characterized by a pulse width modulation base time, a pulse width and a pulse phase. Shifted pulse width modulation is defined as pulse width modulation in which the PWM frequency, PWM time and PWM phase can be adapted. Preferably PWM frequency (PWM base time) is kept constant and pulse width and pulse phase of the lasers or laser arrays are adapted such that printing errors (e.g. visible seam lines) are avoided. The pulse width and amplitude may further be used to control the electrical energy which is supplied to the lasers, laser arrays or laser modules. The PWM frequency is preferably selected to allow sub pixel resolution when scanning at full speed (e.g. 300 mm/s). This means that laser light emitted by a laser or laser array which is imaged to one pixel in the working plane moves only a part of the total size of the pixel if the laser or laser array is activated in two subsequent periods of the PWM frequency. An area element in the working plane with the size of a single pixel thus receives laser light from the same laser or laser module in subsequent periods of the PWM cycle while moving across the working plane. Shifted PWM enables to drive lasers or laser arrays of one laser module independently. This means, for example, that neighbouring lasers, laser arrays all laser modules are activated at different time periods of the PWM cycle. Pulse width and amplitude may be adapted such that each laser or laser array of the laser module emits the same optical power to the working plane. Alternatively, pulse width an amplitude may be used to adapt the optical power emitted by each laser or laser arrays of a laser module. The distribution of the pulse phases and pulse width is adapted such that the current which is provided to one laser module is essentially constant. Current peaks may be avoided by means of this distribution of starting times of the laser pulses across the longer PWM base time. The printing error which may be caused by means of the pulse shift is limited if the PWM frequency is chosen such that a sub pixel resolution is possible. It may even be possible to increase the PWM frequency depending on the pulse shift applied to the lasers, laser arrays, laser modules or group of laser modules.

Anyhow, the adaption of the PWM frequency may also influence the distribution of the pulses within the shorter or longer PWM base time. The pulse width or length and/or the amplitude may be used in order to reduce the electrical power which is supplied to the lasers, laser arrays or laser modules in accordance with a reduction of the printing velocity. The distribution of the pulse shifts of pulses emitted by lasers of one laser module may be randomised in order to avoid or at least to reduce visibility of seam lines. Systematic shifts of pixels in the working plane are avoided.

The laser modules and/or the electrical power supply may comprise buffer capacitors. The buffer capacitors are adapted to store energy to supply electrical power to the laser modules such that more than the predefined number of laser modules can be driven at nominal electrical power for a predefined period of time. The buffer capacitors may be further adapted to smooth a drive current provided to the part of the laser modules below a threshold current. The drive current may be smoothed by avoiding peak currents. The buffer capacitors may preferably be used as energy storage such that the power supply or power supplies can be supported by means of the buffer capacitors in order to avoid unwanted variations of the current. The buffer capacitors may, for example, be configured such that the current provided to the laser modules can be stabilized a predefined time period at the intended or needed current. Suitable buffer and filter stage may be arranged in the power distribution may thus help to avoid current peaks and to enable fast or even maximum processing speed for short time periods in which more than the predefined number of laser modules have to be activated in order to process a given structure. The buffer or filter stages usually comprise capacitors which are preferably arranged in current nodes.

There may be different steps of filtering or buffering, a. Medium frequency filtering to smooth out modulation at PWM base frequency
   i. This filtering is already required also for normal operation, as power modulation by PWM is a basic requirement of the system
   ii. Total current to filter is reduced if shifted PWM pulses are implemented
b. Medium/low frequency filter
   i. Using decreasing PWM frequency at smaller printing speed requires the filter to be effective at lower frequencies
c. Very low frequency filter/buffer
   i. Any time there is a pattern to be printed requiring more than the total designed power the speed of the whole cycle needs to be reduced
   ii. To reduce the number of these slowed down cycles to a minimum a buffer has to be added, allowing e.g. riding through about 99% of the usual printing situations An estimation of very low frequency filter/buffer by providing electrical power in buffer capacitors is given by the following example. For example it can be assumed that in 99% of layers a maximum of 3 consecutive millimeters has to be printed where all pixels have to be activated at the same time. Printing 3 mm at 300 mm/s means that there are 10 ms which have to be bridged by the buffer capacitors. For example a delta U of 5V is allowed at 24V bus. Furthermore, 14 A current per module are needed. This results in 28.000 μF additional capacitance per module which is required in order to supply this electrical power in the short time period of 10 ms. Commercially available capacitors with 27.000 μF/35V have a diameter of around 35 mm and a height of around 50 mm. Alternative design options may allow high dU which can be used to reduce capacitance requirement. At least a part of the buffer may be implemented at the external power supply depending on wiring to outside. The controller may thus be configured such that all laser modules can be driven at nominal electrical power for a limited time period. The electrical power may be provided in this case by means of buffer capacitors as described above. Lasers, laser array or all laser modules are switched off or production speed is reduced as soon as the limited time period exceeds a threshold value which is given by the required current, the voltage change and the capacitance of the buffer capacitors as described above.

The laser modules of the laser printing system may be arranged in columns, preferably in diagonal columns. One electrical power supply is adapted to supply electrical power to all laser modules of one column. The controller is adapted to adapt the pulse width modulation base time such that the distance of the laser pulses received on the object remains constant. The controller is further adapted to keep the pulse width of the lasers constant. The pulse width may depend on the material and other boundary conditions of the printing process. The controller is further adapted to control the power supply such that a reduction of electrical power supplied to the laser modules is adapted to a reduction of the processing speed at a constant printing resolution. The printing resolution is given by the distance between the laser pulses received on the surface of the object and remains constant. The reduction of electrical power supplied to the laser module may be proportional to the reduction of the processing speed (or the reduction of processing speed may be proportional to the reduction of power supplied to the laser module). This means that at 50% of the maximum speed only 50% of the nominal electrical power is maximally supplied to the lasers or laser arrays. The laser modules and/or the electrical power supply may additionally comprise buffer capacitors in order to smooth or stabilize electrical current supplied to the laser modules as described above.

According to a further embodiment one electrical power supply may be adapted to supply electrical power to all laser modules of one column if the laser modules are arranged in columns. The controller may be adapted to supply interleaving pulse width modulation pulses at constant pulse width modulation base time to the lasers or laser arrays of the diagonal column such that the drive current supplied by the electrical power supply is smoothed. The controller is preferably adapted to start pulses with a defined pulse width for activating the lasers during the pulse width modulation base time at different times, wherein the different times of starting the pulses are distributed across the pulse width modulation base time. Lasers or laser arrays of the laser modules of the column which is supplied by one power supply are therefore activated at different time periods of the PWM cycle. Pulse width and amplitude are preferably adapted such that each laser or laser array of the laser modules emits the same optical power to the working plane. The distribution of the pulse phases and pulse width is adapted such that the current which is provided to one laser module is essentially constant. Current peaks may be avoided by means of this distribution of starting times of the laser pulses across the longer PWM base time. The printing error which may be caused by means of the pulse shift is limited if the PWM frequency is chosen such that a sub pixel resolution is possible. The shifts of the different times of starting the pulses may be randomly distributed across the lasers or laser arrays such that systematic printing errors are reduced.

The controller may be further adapted to start pulses of one laser module during the pulse width modulation base time at the same time if the laser modules are arranged in columns and one electrical power supply is adapted to supply electrical power to all laser modules of one column. The controller may be further adapted to start pulses provided to the lasers of different laser modules during the pulse width modulation base time at different times, wherein the different times of starting the pulses are distributed across the pulse width modulation base time. The total current of one row is limited and smoothed by means of the different start times of laser modules within the row. Buffer or filter capacitors may be used to smooth the current as described above. The shifts of the different times of starting the pulses of the different laser modules may be randomly distributed such that systematic printing errors as, for example, seam lines or steps are avoided or at least reduced.

The laser modules may be arranged in columns, preferably in diagonal columns and one electrical power supply is adapted to supply electrical power to all laser modules of one column and the controller may be adapted such that the pulse width of neighboring laser modules and the pulse phase of neighboring laser modules within a column are adapted such that steps between adjacent pixels on the object are reduced. The pulse length of the laser pulses emitted by the different laser modules is reduced and the phases of the pulses are adapted such that steps between pixels of different laser modules are avoided or reduced. The reduction of the pulse length may depend on the number of laser modules within the diagonal column and the number of the laser modules of this column which can be operated at nominal power at the same time, the PWM base time and the pulse length which is applied if the laser printing system operates at full speed (e.g. less than the predefined number of laser modules are driven at one moment in time). The reduction of the pulse length or width may be used in order to reduce the electrical power which is provided to the laser modules. The phases of the pulses of neighboring laser modules may be adapted such that the pulse of a first one of the laser modules ends when the pulse of a second neighboring laser module starts. Alternatively or in addition may it be possible that there are overlaps or gaps. Control of laser modules of neighboring diagonal columns which are supplied with electrical power by independent power supplies may be further adapted to the control of the laser modules with the diagonal column in order to minimize printing errors. The starting time of neighboring laser modules of neighboring diagonal columns may, for example, be different in order to avoid systematic printing errors. A first group of laser modules may, for example, be arranged in a row, especially diagonal row. Each laser module may comprises several semiconductor lasers or arrays of semiconductor lasers. The pulses within each laser modules may not be shifted with respect to each other. This may simplify control of the single laser modules. The pulses of different laser modules of the first group of laser modules may be shifted instead in order to enable the required reduction of input power. An optimize distribution of the pulse shifts in order to enable small triangle printing errors may be that the shift with respect to the beginning of the pulse from one first laser module of the first group of laser modules to the next laser module of the group of laser modules may be the pulse width modulation base time divided by the number of laser modules within the group of laser modules. The shift between the laser modules in the next group of laser modules adjacent to the first group of laser modules may be arranged in the same way but with reversed order. This means, for example, if the groups of laser modules are arranged in columns or rows the laser modules of different groups of laser modules are arranged in lines. The first laser module of the first group of laser modules is arranged in the first line. The last laser module of the first group of laser modules is arranged in the $n^{th}$ line. The shifts of the pulses of the first laser module of the first group of laser modules is zero and the shift of the pulses of the $n^{th}$ laser module of the first group of laser modules is (n−1) times the shift (pulse width modulation base time divided by n) between adjacent laser modules within the first group of laser modules. The pulse of the first laser module of a second group of laser modules next to the first group of laser modules (second row) which is also arranged in the first line is shifted (n−1) times the shift between adjacent laser modules within the first and second group of laser modules. The shift of the pulses of the $n^{th}$ laser module of the second group of laser modules (in the $n^{th}$ line) is zero. The scheme of the pulse shifts in a third group of laser modules is the same as in the first group of laser modules and in a fourth group of laser modules it is the same as in the second group of laser modules and so on. This procedure may be further optimized by taking into account the geometric distance between the laser modules mapped to the working area such that the energy received in the working area is not only optimized with respect to time but especially with respect to the material which receives the energy while smoothening the driving current over time.

The laser printing system may comprise laser modules which are arranged in diagonal columns as described above. One electrical power supply may in this alternative embodiment be adapted to supply electrical power to all laser modules of a least two diagonal columns. The at least two diagonal columns comprise a common buffer capacitance. The controller is adapted to supply interleaving pulse width modulation pulses at constant pulse width modulation base time to the lasers of the at least two diagonal columns such that the drive current supplied by the electrical power supply is smoothed. The one electrical power supply may be adapted to supply electrical power to all laser modules of two, three, four or even all diagonal columns which are arranged on the print head. The pulse shift may be regularly increased across the diagonal columns which are supplied by the common power supply. This may be especially useful in case that all diagonal columns are supplied by one common power supply. Pulse lengths and start time of the pulses within one period of the PWM modulation which are supplied to the different laser modules are preferably randomized within the period of the PWM modulation in order to avoid or reduce systematic printing errors.

The controller may be adapted to control the laser modules such that a phase shift of laser pulses received on the object is reduced. The phase shift between neighboring pulses which are received on the object is preferably minimized. This means that path lengths and starting times are preferably adapted such that there is only a small distance between a first pulse received on the object and a second neighboring pulse received on the object. It may be preferred in this case to provide a regular pattern of phase shifts and adapted pulse lengths in order to simplify control of the laser modules. The regular patterns are preferably chosen such that monotonous shifts of the pulses across several neighboring laser modules are avoided. The shifts may in this case become bigger but visibility may be reduced due to the irregularities. An example of such a monotonous shift may be that a first laser module starts at time t1, a second neighboring laser module starts at t2 and a third neighboring laser module starts at t3 etc., wherein $t1<t2<t3<\ldots$. Pulse pattern according to, for example, $t1<t3<t2<\ldots$ which are not monotonous may be preferred.

A further embodiment of the laser printing system may be arranged such that a combination of adaptive PWM modulation base time and adaptive PWM pulse lengths is enabled. The controller is configured to adapt the pulse width modulation base time such that the distance between laser pulses received on the object remains essentially constant. The controller is further configured to adapt the pulse width of the lasers such that a part of a reduction of electrical power supplied to the laser modules is caused by a shortened pulse width. The pulse width or length may be used in order to reduce the electrical power which is supplied to the lasers, laser arrays or laser modules in accordance with a reduction of the printing velocity. Only a part of the power reduction is done by shortening the pulse. Doing all reduction by shorter pulses especially at constant pulse width modulation base time is not possible as pulse time resolution is limited and thus relative steps between levels become too large at very low required power levels. It is thus necessary to adapt the power by means of the amplitude of the pulse in addition. The pulse length is preferably reduced to a minimum in order to reduce the effective sub pixel dimension. A remaining power change may be compensated by means of pulse width modulation base time or amplitude of the pulse. This helps to avoid or at least reduce printing errors which may be caused by switching the lasers, laser arrays or laser modules by means of PWM.

Shifting the pulse phase between lasers, laser arrays or laser modules as described above may be used to avoid current peaks. Buffer capacitors as described above may be used in addition to store electrical energy and to smooth the electrical current. The laser modules are preferably arranged in diagonal columns and one electrical power supply is adapted to supply electrical power to all laser modules of at least one diagonal column. One power supply may also be configured to supply electrical power to two, three, four or more columns arranged on the print head. Alternatively, other regular arrangements of the laser modules may also be possible wherein groups of the laser modules are supplied by one common electrical power supply.

The controller may in a further embodiment be adapted to keep the pulse width modulation and the pulse width of the lasers constant. The controller is further adapted to skip pulses in accordance with a reduction of the processing speed. Skipping pulses or switching of lasers, laser arrays or complete laser modules within a PWM cycle may be used to adapt the electrical power provided to the laser, the laser arrays or laser modules if the processing speed is reduced. Skipping of laser pulses causes that the energy is received in the working plane at the same place but a later moment in time. The change of the dynamic of reception of optical power in the working plane influences the distribution of thermal energy. The pattern of switching off lasers, laser arrays or laser modules may thus be adapted to the material which has to be sintered. The pattern may depend on particle size, particle size distribution, particle shape, thermal conductivity and the like. The laser modules which are arranged on the print head are preferably arranged in diagonal columns, wherein one electrical power supply is adapted to supply electrical power to all laser modules of at least one diagonal column. One power supply may also be configured to supply electrical power to two, three, four or more columns arranged on the print head. Alternatively, other regular arrangements of the laser modules may also be possible wherein groups of the laser modules are supplied by one common electrical power supply.

The laser printing system may in an alternative embodiment be configured such that all laser modules of a group of laser modules share the electrical power supply. The controller is adapted to switch off at least one laser module of the group of laser modules if the optical energy to be provided to the object within a predefined time period requires an electrical input power exceeding the nominal electrical power of the laser modules times the predefined number of laser modules. The controller is further adapted to switch off the at least one laser module such that a full width of the print head can be processed within at least two passes of the print head across the object. The width of printing is effectively reduced and second, third, fourth etc. passes of sintering per layer are added. The system may, for example, reduce the width of the printed area at 100% layers to 25%, keeping power demand on 25%, then print the second quarter of the layer on the way back, the third quarter in a next way forward and the last quarter on a fourth way back. At least a part of the laser modules which are switched off in a first printing step are switched on in a second printing step. The effect of switching off laser modules is that the print head can be moved at maximum processing speed but only a part of the surface in the working plane is processed in one run across the working plane. The effect of cooling down at the edges of the structures in the working plane which were processed in a first run may be compensated by adapting the optical power provided to the edges such that visible seam lines are avoided or at least reduced. The width of the printed area may, for example, be reduced to 51% instead of 50% in a first run at an optical energy provided at the edges to the area which should be processed in the second run is adapted to the energy which will be provided in this second run which covers 51% instead of 50%, too. The profile of the optical energy provided at the edge in the second run compensates for the energy loss which is caused by the time between the first run and the second run. It may be advantageous that the group of laser modules which are supplied by one power supply comprises all laser modules arranged on the print head.

According to a further aspect of the present invention a method of laser printing is provided. The method comprises the steps of:

- moving an object in a working plane relative to a print head, the print head comprising a total number of laser modules, wherein at least two of the laser modules share an electrical power supply;
- emitting laser light by means of the laser modules, the laser modules comprising at least one laser array of lasers; and
- controlling the laser modules such that at maximum processing speed of the print head only a predefined number of laser modules can be driven at nominal electrical power wherein the predefined number of laser modules is smaller than the total number of laser modules.

The method steps need not necessarily be performed in the order given above. Moving the print head, emitting laser light and controlling the laser modules may, for example, be performed essentially at the same time.

The step of controlling the laser modules such that at maximum processing speed of the print head only a predefined number of laser modules can be driven at nominal electrical power wherein the predefined number of laser modules is smaller than the total number of laser modules does not exclude that all laser modules can be driven at nominal electrical power for a limited time period. The electrical power may be provided in this case, for example, by means of buffer capacitors as described above. Lasers, laser array all laser modules are switched off or production speed is reduced as soon as the limited time period exceeds a threshold value which is given by the required current, the voltage change and the capacitance of the buffer capacitors as described above. The time at which the processing or production speed is reduced can be determined by means of the shape of the object to be printed. The adaption of the velocity may be performed layer by layer or dynamically within each layer. Keeping the velocity constant within a layer may simplify the production process because slow down or acceleration of the print head or the laser modules needs not to be taken into account. Buffer capacitors may be used in order to minimize the number of layers which are printed at lower velocity. Dynamic adaption on the other side may enable faster printing processes.

It shall be understood that the laser printing system of claim 1 and the method of claim 15 have similar and/or identical embodiments, in particular, as defined in the dependent claims.

It shall be understood that a preferred embodiment of the invention can also be any combination of the dependent claims with the respective independent claim.

Further advantageous embodiments are defined below.

BRIEF DESCRIPTION OF THE DRAWINGS

These and other aspects of the invention will be apparent from and elucidated with reference to the embodiments described hereinafter.

The invention will now be described, by way of example, based on embodiments with reference to the accompanying drawings.

In the drawings:

FIG. 1 shows a principal sketch of a cross-section of a laser printing system according to a first embodiment.

FIG. 2 shows a principal sketch of a top view of a laser printing system according to a second embodiment.

FIG. 3 shows a principal sketch of a top view of a laser printing system according to a third embodiment.

FIG. 4 shows a principal sketch of a print head according to a first embodiment.

FIG. 5 shows a principal sketch of a print head according to a second embodiment.

FIG. 6 shows a principal sketch of a print head according to a third embodiment.

FIG. 7 shows a principal sketch of a print head according to a fourth embodiment.

FIG. 8 shows a principal sketch of a laser module according to a first embodiment.

FIG. 9 shows a principal sketch of a group of laser modules according to a first embodiment.

FIG. 10 shows a principal sketch of a group of laser modules according to a second embodiment.

FIG. 11 shows a principal sketch of a first PWM driving scheme

Figure 12:
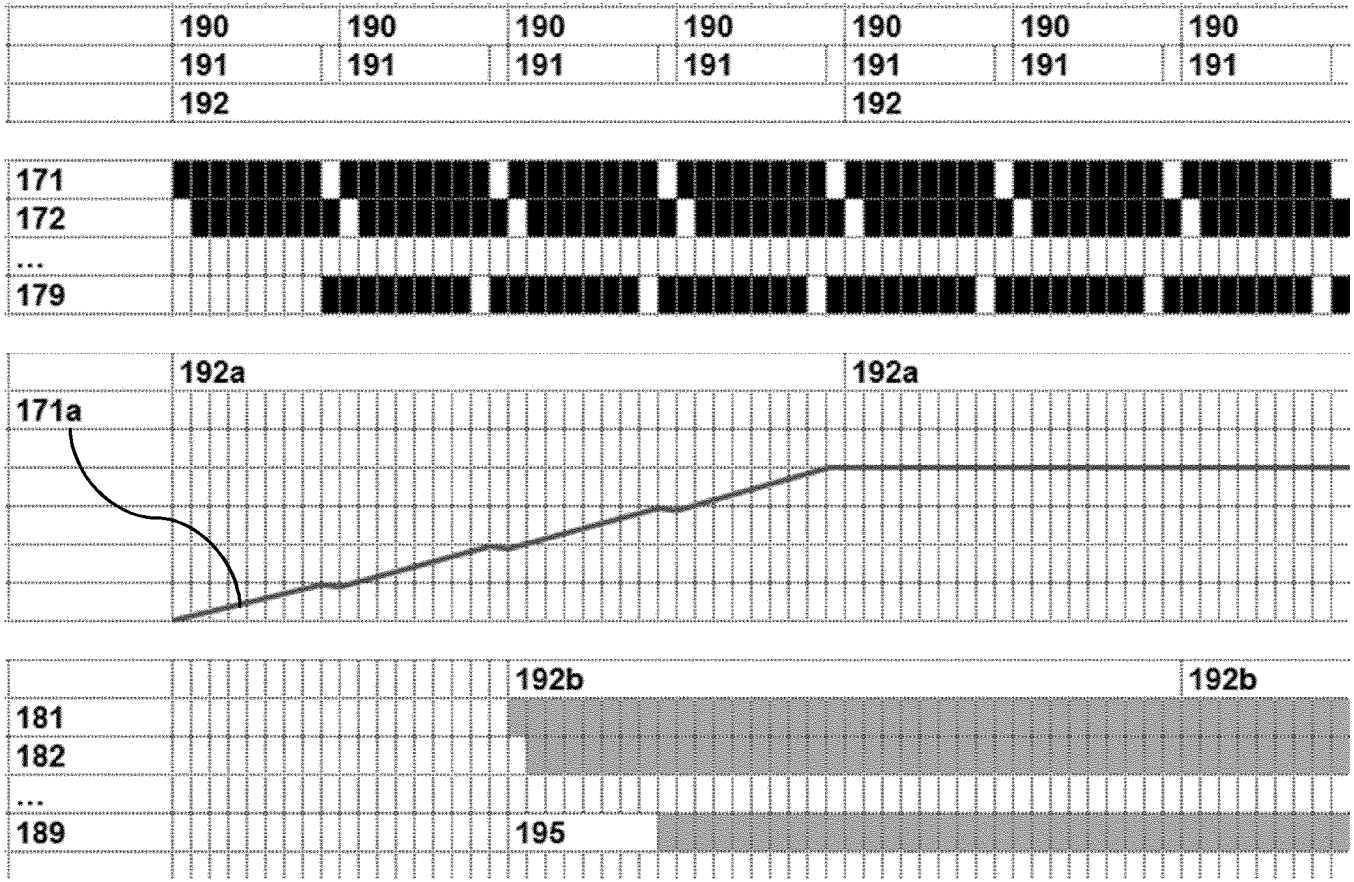

FIG. 12 shows a principal sketch of a second PWM driving scheme

Figure 13:
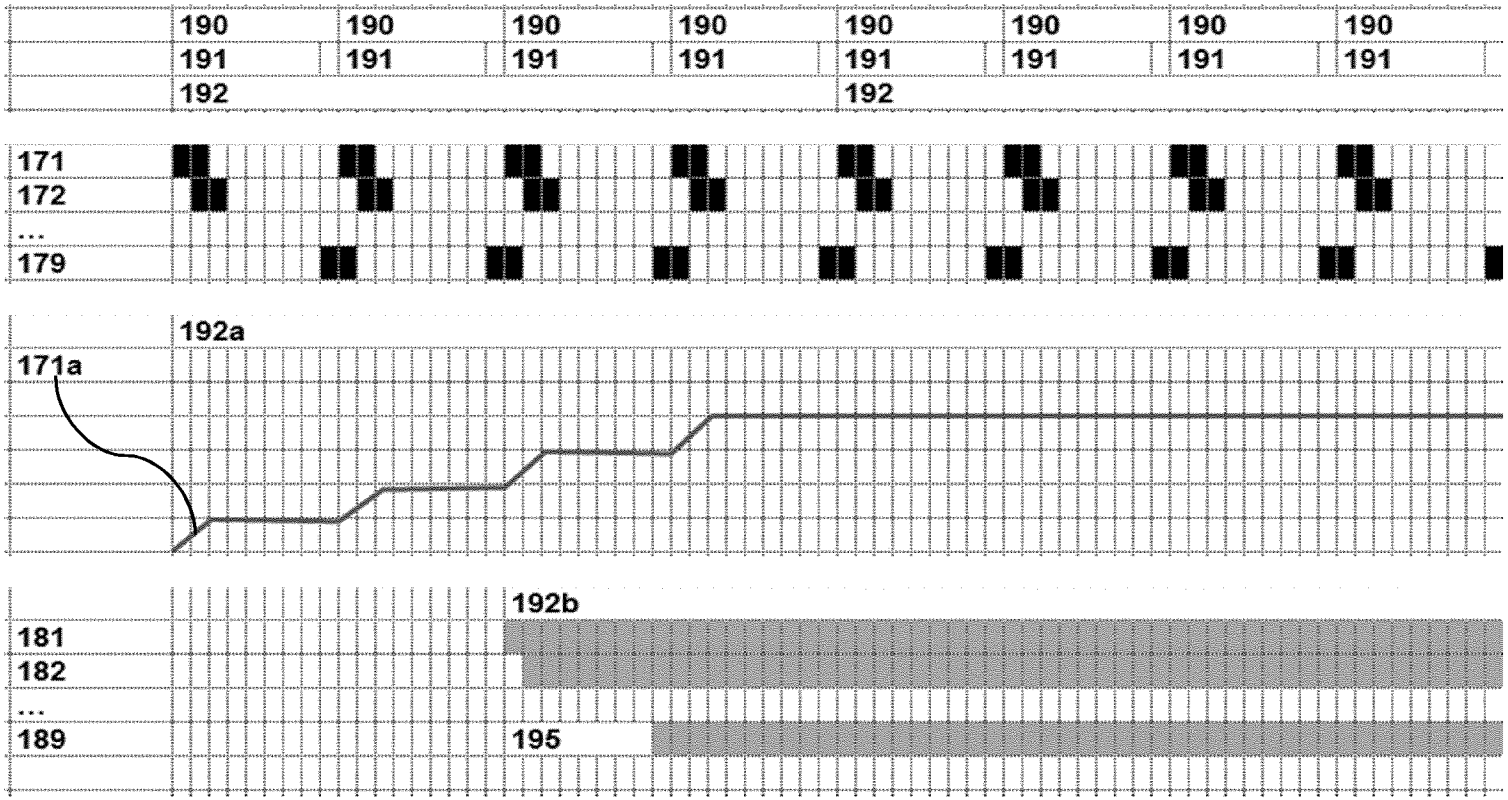

FIG. 13 shows a principal sketch of a third PWM driving scheme

Figure 14:
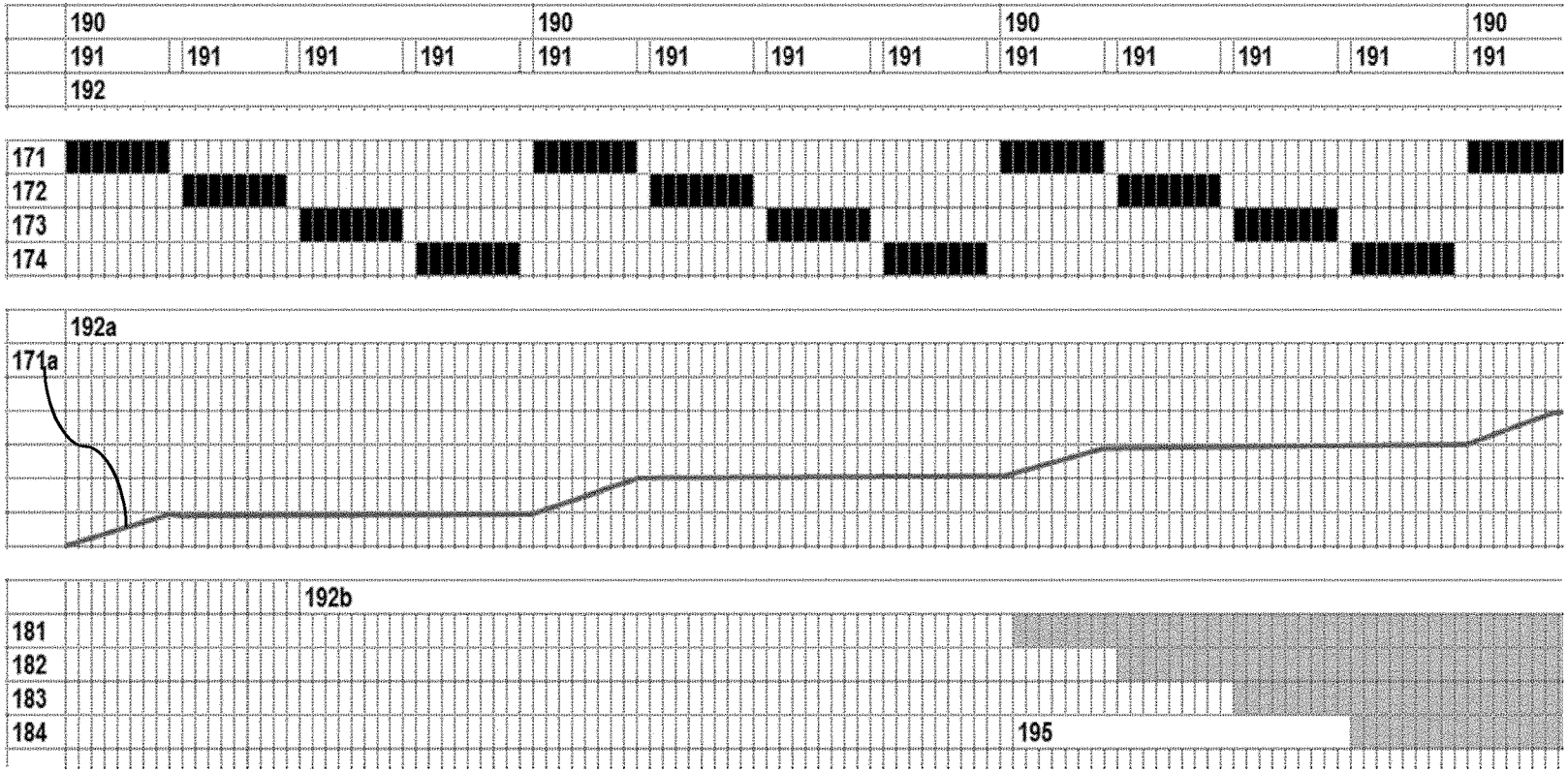

FIG. 14 shows a principal sketch of a fourth PWM driving scheme

Figure 15:
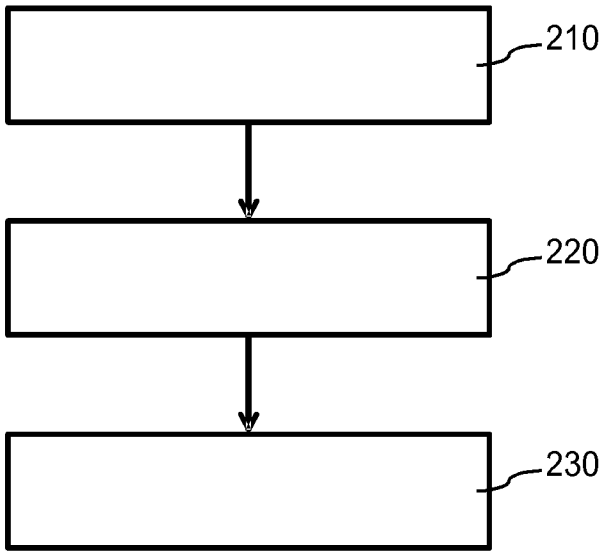

FIG. 15 shows a principal sketch of method steps of a method of laser printing.

In the Figures, like numbers refer to like objects throughout. Objects in the Figures are not necessarily drawn to scale.

DETAILED DESCRIPTION OF EMBODIMENTS

Various embodiments of the invention will now be described by means of the figures.

Figure 1:
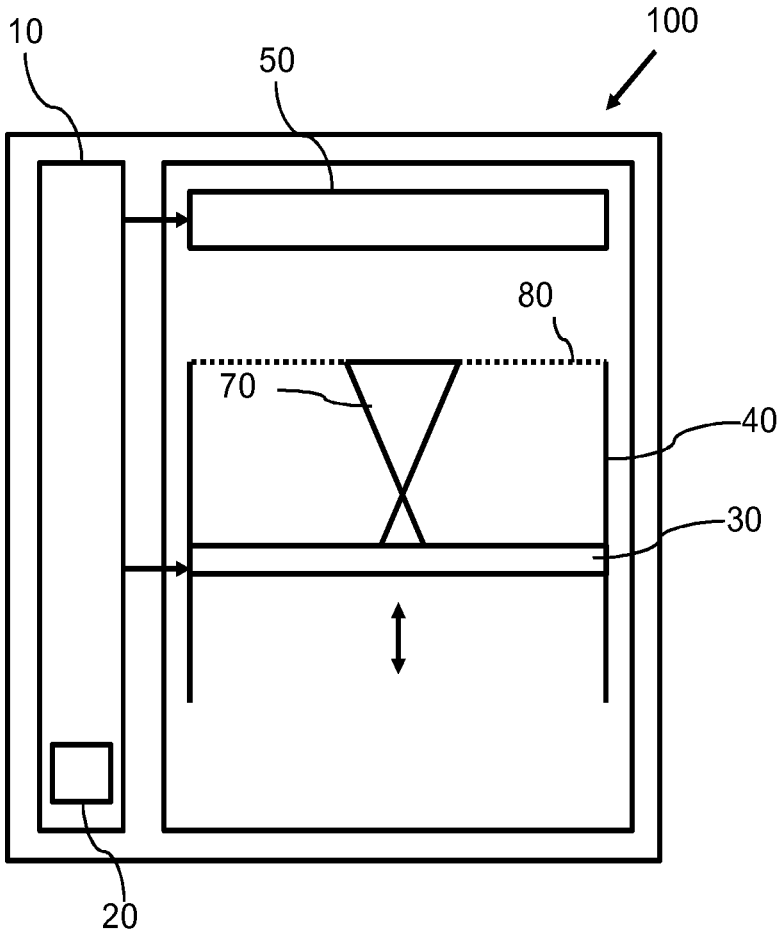

FIG. 1 shows a principal sketch of a cross-section of a laser printing system according to a first embodiment. The laser printing system 100 comprises a process chamber with an object carrier 30 for carrying building material and a three-dimensional object 70 to be built thereon. On the object carrier 30 a building platform may be a provided which serves as a removable base for removing the object 70 after the building process is finished. A frame 40, such as vertical walls, may be arranged around the object carrier 30 to confine layers of the building material on the object carrier 30. The frame 40 may be removable, which may comprise a vertically movable base which is removably attached to the object carrier 30. A print head 50 is arranged above the working plane 80. The print head 50 is movable across the working plane 80 in a direction indicated by the double sided arrow in FIGS. 2 and 3. The print head 50 may be configured to be moved back in an opposite direction. The print head 50 comprises laser modules 150 (not shown) which may be adapted such that the working plane can be illuminated if the print head 50 moves in both directions indicated in FIGS. 2 and 3. The object carrier 30 is movable up and down relative to the print head 50 in a vertical direction, i.e. in a direction perpendicular to the direction of movement of the print head 50. Movement of object carrier 30 is controlled by means of a controller 10 in such a manner that an uppermost layer of the building material forms the working plane 80. The laser printing system further comprises the controller 10 for controlling various functions of the laser printing system. The controller comprises a power supply 20 which is configured to supply electrical power to all laser modules 150 of the print head 50. A recoating device (not shown) may be provided to apply layers of building material onto the building platform of the object carrier 30. Furthermore, one or more separate heating device(s) (not shown) may be provided that may be used to heat an applied layer of building material to a process temperature and/or to control the temperature of the building material within the frame 40, if necessary. The building material preferably is a powder material that is configured to transform under the influence of the laser light emitted by the lasers 115 into a coherent mass. The transformation may include, for example, melting or sintering and subsequent solidification and/or polymerization in the melt. The building material may be a plastic powder, for example, a thermoplastic powder. Examples of such plastic powders are PA 12 (polyamide 12) or other polyamides, polyaryletheretherketone, such as PEEK or other polyetherketones. The powder may also be a powder from a metal or a metal alloy with or without a plastic or metal binder, or a ceramic or composite or other kind of powder. Generally, all powder materials that have the ability to transform from powder into a coherent mass under the influence of the laser light emitted by the lasers 115 can be used. The building material may also be a paste-like material including a powder and an amount of liquid. Typical medium grain sizes of the powder lie between 10 μm and 100 μm. The emission wavelength of the lasers 115 is preferably in the near infrared range of the spectrum. A preferred wavelength range may be between 750 nm and 1200 nm. Examples of wavelengths which are used in present systems are, for example, 980 nm or 808 nm. The powder material may comprise laser light absorbing additives which absorbs laser light in the emission wavelengths of the lasers 115. An example of such an additive may be but not limited to Carbon Black which is suitable to enable a sufficient absorption of the preferred wavelengths described above. In principle any wavelength is possible as long as a suitable absorber material can be added to the powder material or the powder material itself is characterized by sufficient absorption at the emission wavelengths of the lasers 115.

Figure 2:
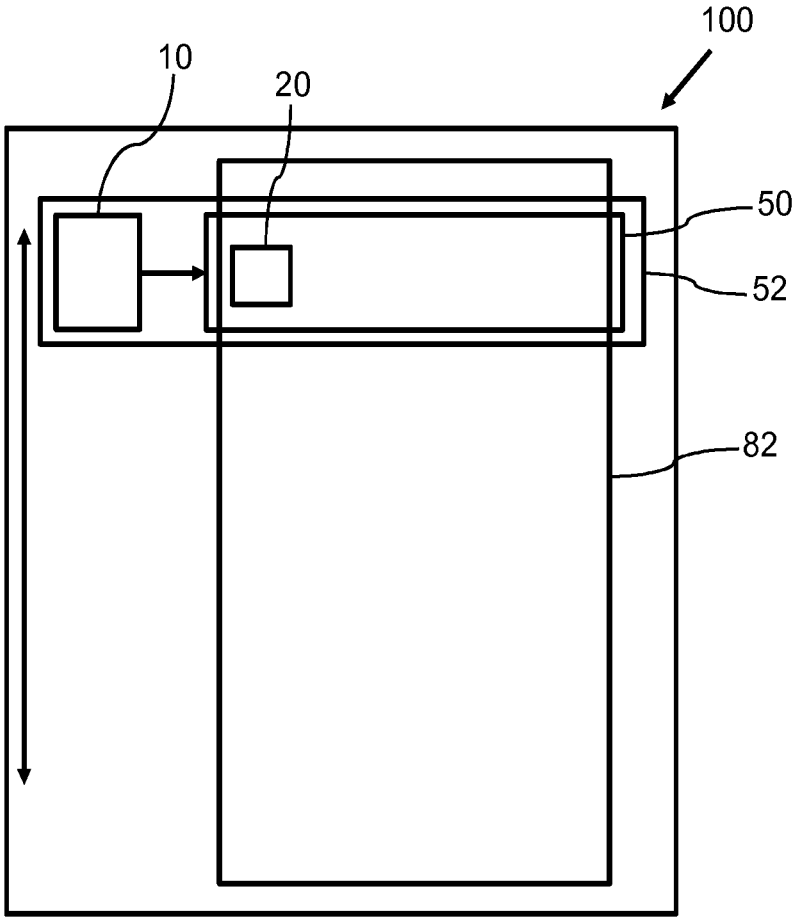

FIG. 2 shows a principal sketch of a top view of a laser printing system according to a second embodiment. A working area 82 may be defined by the frame 40. The working area 82 may have a rectangular contour. The working area 82 may have any other contour such as but not limited to a square-shape, a circular contour or the like. The print head 50 is mounted on a print carrier 52. The print head comprises one common power supply 20 configured to drive all laser modules 150 (not shown) mounted on the print head 50. A controller 10 is monolithically integrated with the print carrier 52. The print carrier 52 and controller 10 can move in the directions indicated by the double sided arrow at the left side.

Figure 3:
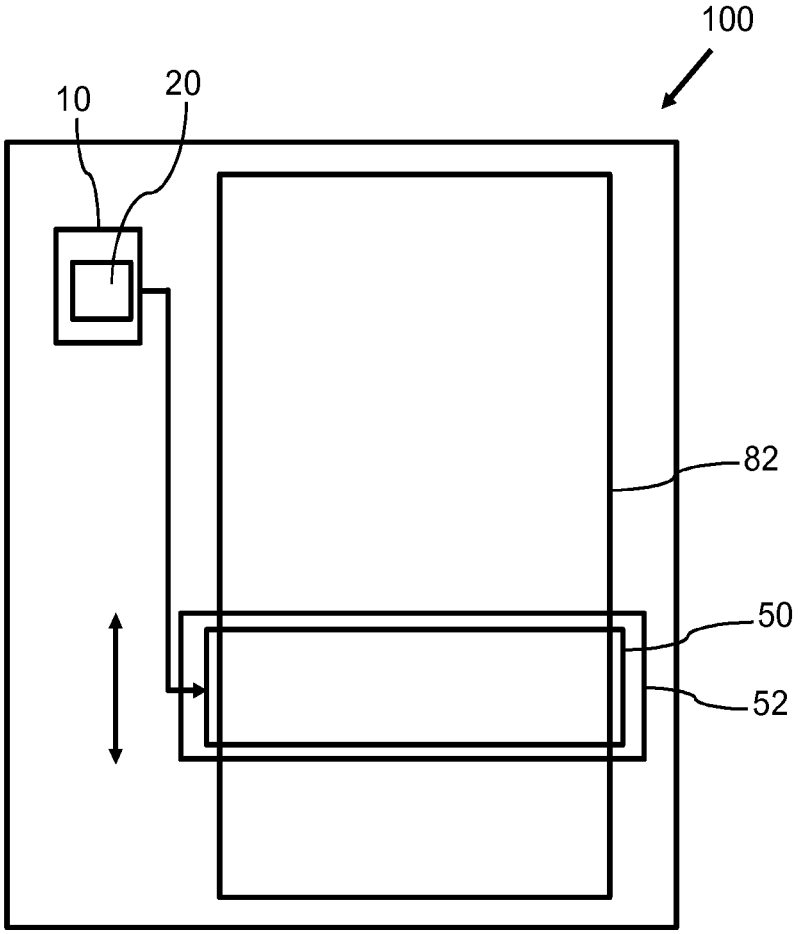

FIG. 3 shows a principal sketch of a top view of a laser printing system according to a third embodiment. The third embodiment is quite similar to the second embodiment. The print carrier 52 and the controller 10 are in this case separated. Only the print carrier 52 with the print head 50 is configured to move in the directions indicated by the double sided arrow. Controller 10 comprises power supply 20 which is adapted to provide electrical power to all laser modules 150 (not shown) mounted on print head 50. Controller 10 and power supply 20 provides control signals and electrical power the flexible wires to the laser modules 150 mounted on the print head 50.

Figure 4:
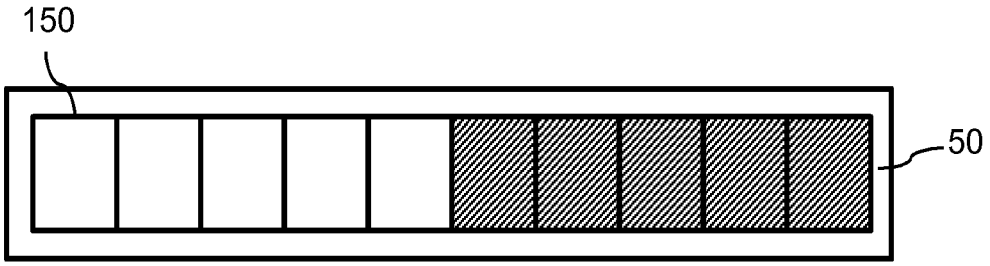

FIG. 4 shows a principal sketch of a print head 50 according to a first embodiment. The print head 50 comprises ten laser modules 150. All laser modules 150 are commonly supplied with electrical power by a common electrical power supply 20 as shown, for example in FIG. 3. Furthermore, all laser modules 150 are commonly controlled by controller 10 as shown, for example, in FIG. 3. The five laser modules 150 on the left of the print head 50 are switched on and the five laser modules 150 on the right are switched off (indicated by the grey shading) by means of controller 10. The print head 50 has to move two times across the working area 82 in order to process one complete layer. The controller 20 is in this case adapted such that at maximum processing speed of, for example, 300 mm/s only five of the 10 laser modules 150 can be driven at nominal electrical power such that each laser 115 comprised by the laser modules 150 can emit, for example, 1.5 W optical power.

Figure 5:
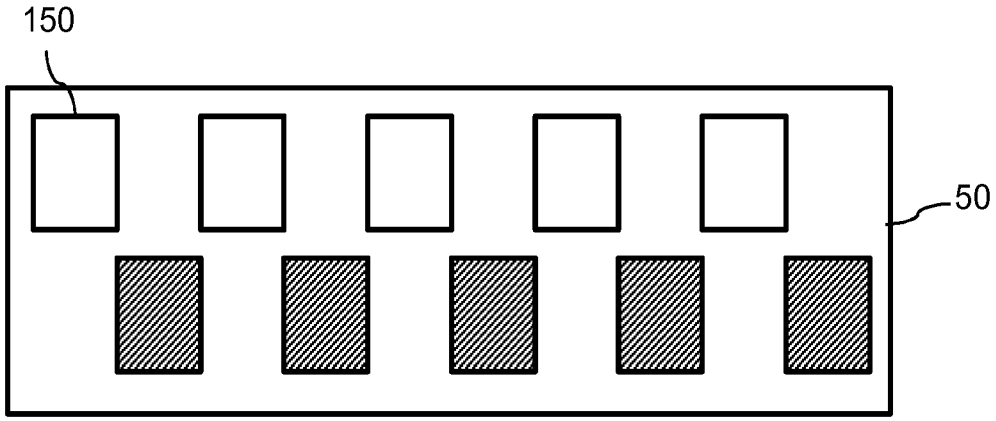

FIG. 5 shows a principal sketch of a print head 50 according to a second embodiment. All laser modules 150 are commonly supplied with electrical power by a common electrical power supply 20 as shown, for example in FIG. 2. Furthermore, all laser modules 150 are commonly controlled by controller 10 as shown, for example, in FIG. 2. The laser modules 150 are arranged in two lines. The distance between the laser modules 150 in the first line is such that a laser module 150 of the second line can fill the gap. The laser modules 150 of the second line are therefore shifted into the gaps between the laser modules 150 of the first line. The five laser modules 150 of the first line of the print head 50 are switched on and the five laser modules 150 on the second line are switched off (indicated by the grey shading) by means of controller 10. The print head 50 has to move two times across the working area 82 in order to process the gaps between the laser modules 150 of the first line. The controller 20 is in this case adapted such that at maximum processing speed of, for example, 300 mm/s only five of the 10 laser modules 150 can be driven at nominal electrical power such that each laser 115 comprised by the laser modules 150 can emit, for example, 1.5 W optical power.

The print head 50 may in alternative embodiments comprise other distributions of laser modules 150 such that the print head 50 has to pass working area 82 three, four, five or more times in order to process a complete layer. The number of passes across the working area 82 is determined by the reduction of power which can be maximally supplied to the laser modules 150 of the print head 50.

Figure 6:
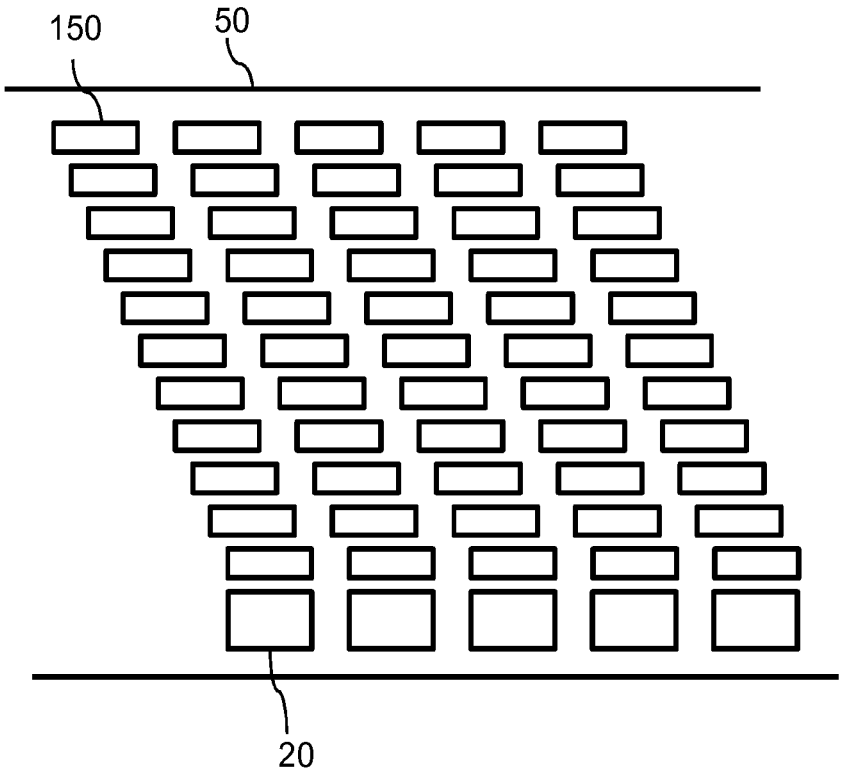

FIG. 6 shows a principal sketch of a print head 50 according to a third embodiment. The print head 50 comprises several diagonal columns of laser modules 150. Each diagonal column of laser modules 150 comprises 11 laser modules 150 which are commonly supplied with electrical power by one electrical power supply 20. The laser modules 150 of one diagonal column are arranged such that in the top view of the part of the print head 50 shown in FIG. 6 each laser module 150 is slightly shifted to the right starting at the upper side of the print head 50. A central controller or main controller 10 similar as shown in the embodiment of FIG. 1 controls the power supplies 20 and laser modules 150. The controller 10 is adapted to control the laser modules 150 with shifted pulse width modulation. The laser modules 150 of one diagonal column are activated at different time periods of the PWM cycle. The pulse width and starting time within the PWM modulation base time of each laser module 150 within a column are chosen such that there is no overlap between the pulses provided to the laser modules 150. The pulses are arranged next to each other essentially without overlap. The current supplied to the laser modules 150 of one column by means of the common electrical power supply 20 is thus smoothed by means of the distribution of the pulses within the PWM cycle. The distribution of the pulse shifts between the laser modules 150 is randomized in order to avoid or at least to reduce seam lines.

Figure 7:
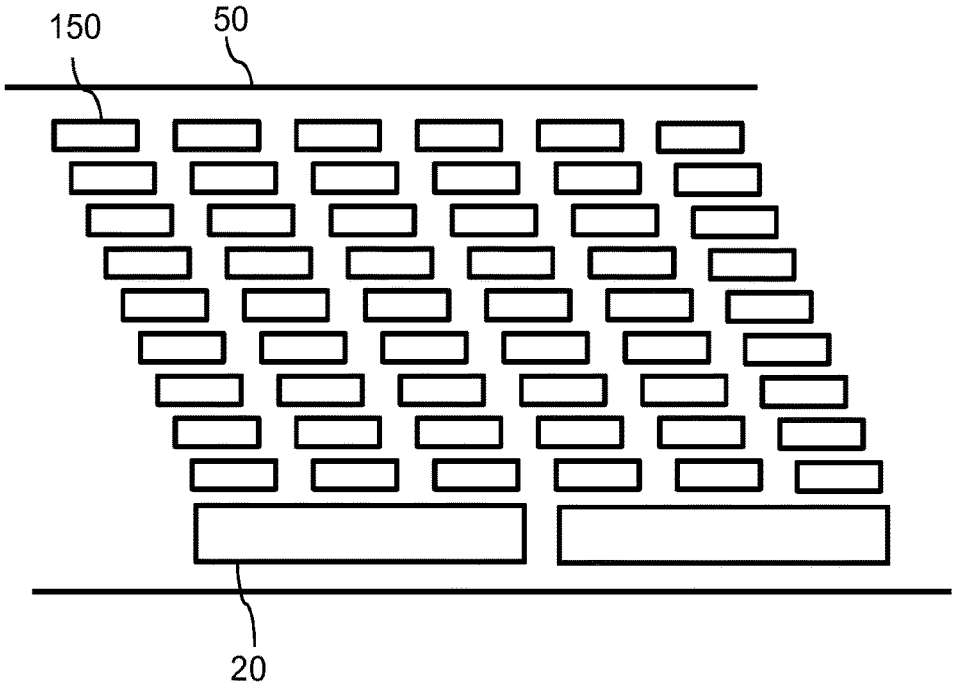

FIG. 7 shows a principal sketch of a print head 50 according to a fourth embodiment. The print head 50 comprises several diagonal columns of laser modules 150. Each diagonal column of laser modules 150 comprises 9 laser modules 150. Three diagonal columns are commonly supplied with electrical power by one electrical power supply 20. The laser modules 150 of one diagonal column are arranged such that in the top view of the part of the print head 50 shown in FIG. 7 each laser module 150 is slightly shifted to the right starting at the upper side of the print head 50. A central controller or main controller 10 similar as shown in the embodiment of FIG. 1 controls the power supplies 20 and laser modules 150. The controller 10 is adapted to control the laser modules 150 with shifted pulse width modulation. The pulse shift is regularly increased across the diagonal columns which are supplied by the common electrical power supply 20. Pulse lengths and start time of the pulses within one period of the PWM modulation which are supplied to the different laser modules 150 are randomized within the period of the PWM modulation in order to avoid or reduce systematic printing errors.

Figure 8:
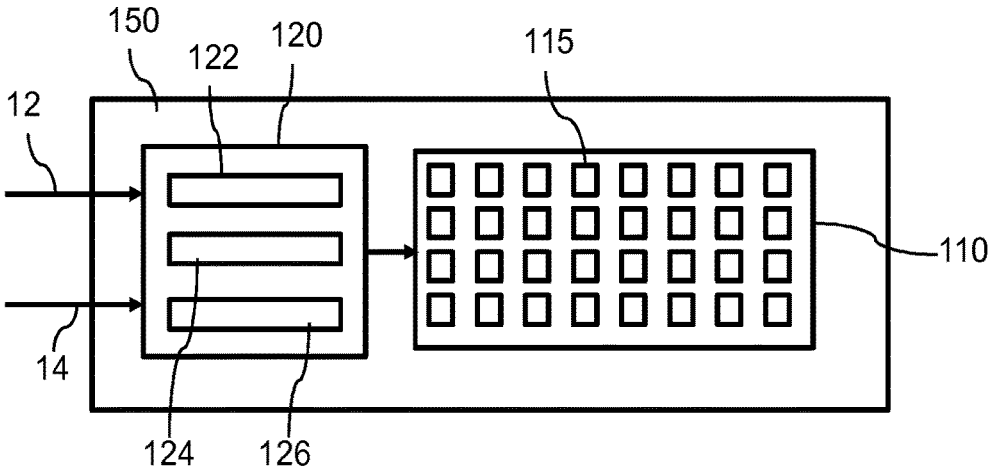

FIG. 8 shows a principal sketch of a laser module 150 according to a first embodiment. The laser module 150 comprises a laser array 110 with 32 lasers 115 (VCSEL) which are arranged in eight columns and four lines. The laser module further comprises a laser driver 120 with a DC/DC converter 122, signal isolation 124 and PWM current source 126. The laser driver 120 is configured to transfer electrical power to the lasers 115 based on data input 12 provided by controller 10 and power input 14 provided by electrical power supply 20.

Figure 9:
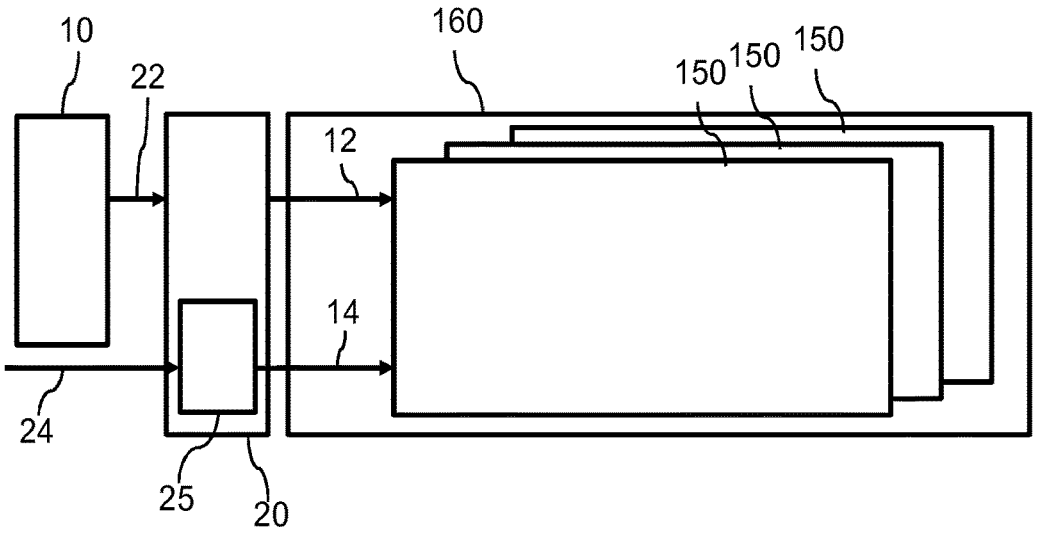

FIG. 9 shows a principal sketch of a group of laser modules 160 according to a first embodiment. The group of laser modules 160 receives power input 14 by means of power supply 20 which comprises a filter 25. The filter 25 comprises buffer capacitors which are arranged to supply electrical power to the laser modules 150 of the group of laser modules 160 beyond the limitations of the electrical power supply 20 (without the buffer capacitors) for small time periods. Electrical power supply 20 receives main power input 24 from a voltage source (240V/400V mains). Electrical power supply 20 further receives main data input 22 from controller 10. The electrical power supply 20 further comprises a microprocessor which is configured to adapt the main data input 22 in accordance with the capabilities of the electrical power supply 20 and to submit data input 12 to laser modules 150 of the group of laser modules 160. Control of the laser modules 150 is provided in this architecture by a distributed arrangement of controller 10, power supply 20 and laser driver 120 shown in FIG. 8.

Figure 10:
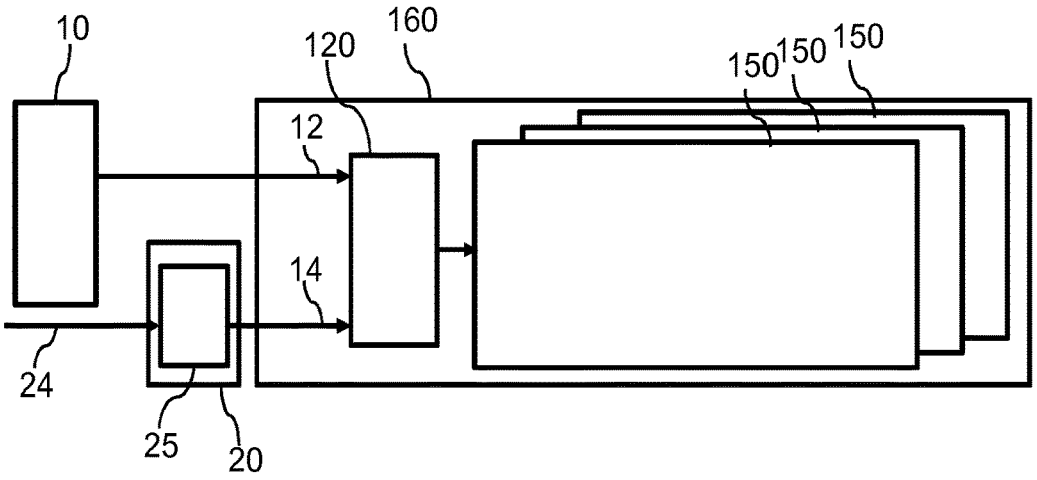

FIG. 10 shows a principal sketch of a group of laser modules 160 according to a second embodiment. The group of laser modules 160 receives power input 14 by means of power supply 20 which comprises a filter 25. The filter 25 comprises buffer capacitors which are arranged to supply electrical power to the laser modules 150 of the group of laser modules 160 beyond the limitations of the electrical power supply 20 (without the buffer capacitors) for small time periods. Electrical power supply 20 receives main power input 24 from a voltage source (240V/400V mains). The group of laser modules 160 comprises one common laser driver 120 which receives power input 14 and data input 12 provided by controller 10. Control of the laser modules 150 is provided in this architecture by a distributed arrangement of controller 10 and common laser driver 120.

Figure 11:
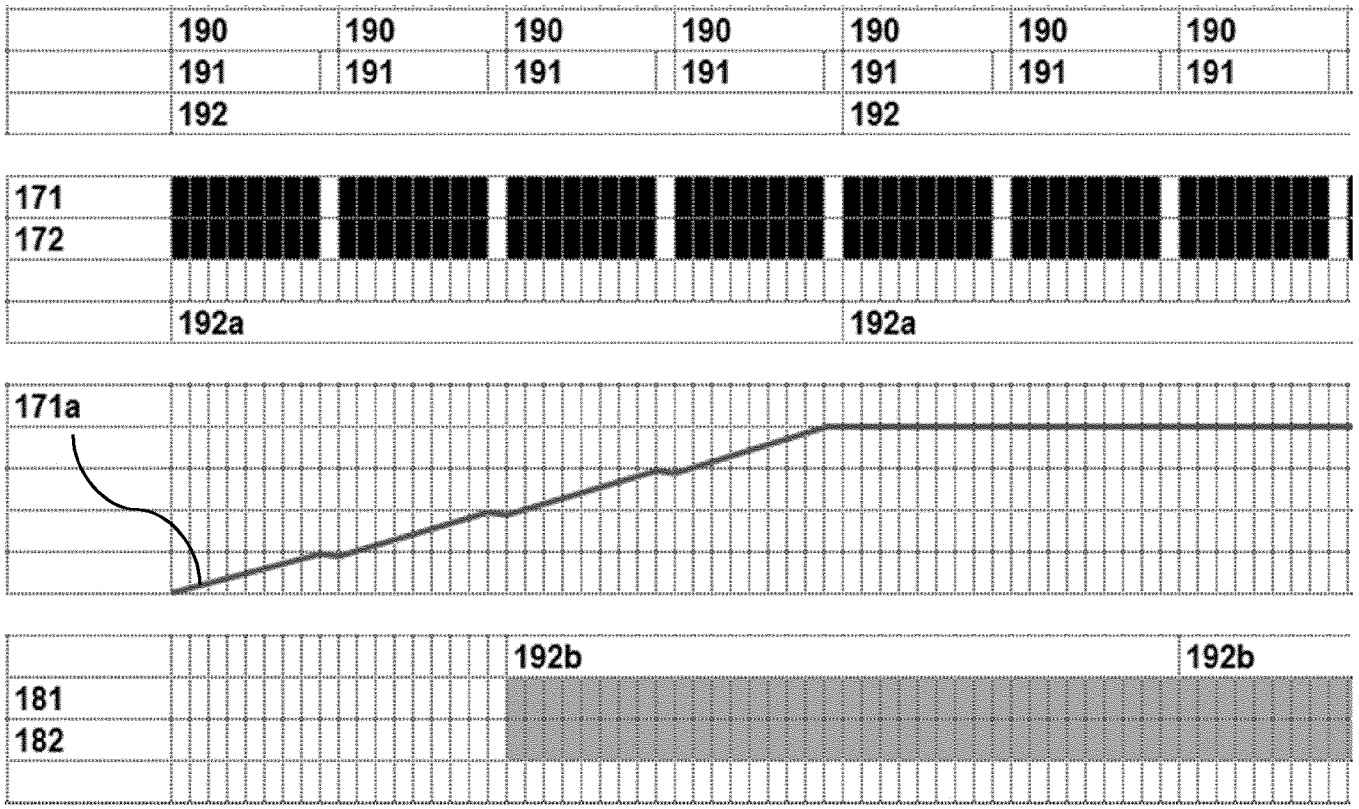

FIG. 11 shows a principal sketch of a first PWM driving scheme. The first PWM driving scheme is a known standard driving scheme in which a first laser pixel 171 and a second laser pixel 172 and further laser pixels (not shown) are driven synchronously. First or second laser pixel 171, 172 and so on means one or more lasers (or laser arrays) which are arranged to be imaged to a corresponding pixel on the object 70. The first line shows the pulse with modulation base time 190. The second line shows the pulse width 191 of the PWM. The pulse width 191 is ⅝ of the pulse width modulation base time 190. The pulse shape is rectangular such that a constant current is supplied to the lasers from the beginning to the end of each pulse. A rectangular pulse is only chosen as an example in order to simplify the discussion. Other pulse shapes may also be used. The third line shows the time of full pixel 192. The time of full pixel 192 comprises four pulse with modulation base times 190 and therefore four pulses with pulse width 191. The more pulses are comprised by the time of full pixel 192 the higher is the sub pixel resolution. The fourth line shows when the first laser pixel 171 is active (black rectangles) which corresponds to the pulse width 191. The fifth line shows when the second laser pixel 172 is active (black rectangles) which corresponds to the pulse width 191. The activity of the first and the second laser pixel 171, 172 are synchronized meaning that all lasers emit laser light at the same time. The example shown in FIG. 11 refers to a laser printing system 100 in which the print carrier 52 moves with a velocity of 500 mm/s. The time of full pixel 192 therefore translates in a corresponding length of full pixel 192*a* in the working plane 80. An energy of first pixel 171 a in the working plane 80 is shown below the length of full pixel 192*a*. The received energy per area element rises during the movement of the print carrier 52 or print head 50 as long as energy is received at the respective area element in the working plane 80. A linear rise of the received energy in the working plane 80 is shown during pulse width 191 followed by a small time of constant received energy at the end of pulse width 191. The rise of the received energy per area element in the working plane 80 continues until the end of the time of full pixel 192. After this moment in time no further energy is received by the corresponding area element from the lasers 115. This maximum of received energy corresponds, for example, to 200% of a predefined energy threshold level at which the material in the working plane 80 is processed. Print head 50 has passed the corresponding area element in the working plane 80. The received energy causes a rise of temperature of the area element. The rise of temperature depends on the material, particle size and other boundary conditions and is not necessarily linear as the energy received by an area element in the working plane 80. The temperature of the area element in the working plane 80 rises until a threshold temperature is reached at which the material starts melting or sintering. This is the starting point of printed full pixel 192*b* in the working plane 80 which corresponds to the length of full pixel 192*a* but shifted because of the time needed to receive sufficient energy in the area element of the working plane 80. The generated first and second pixels 181, 182 in the working plane also start as soon as the temperature reaches the threshold temperature. The generated first and second pixels 181, 182 refer to a connected area or more precise volume of sintered or melted material in the working plane 80. The generated first and second pixels 181, 182 start at the same time or at the same position in the working plane 80 and are synchronized as pulses emitted by the first and second laser pixels 171, 172. There is no phase shift between the pulses.

FIG. 12 shows a principal sketch of a second PWM driving scheme. The structure of FIG. 12 is very similar as the structure of FIG. 11. The difference is that the pulses of different laser pixels 171, 172, . . . , 179 of a group of laser pixels which comprises in this case 9 laser pixels are phase shifted ⅛ of pulse width 191 with respect to each other (or ⅙ of the pulse width modulation base time 190). The pulse width modulation base time 190 is in this case 50 μs. And the pulse width 191 is ⅝ of the pulse width modulation base time 190. The time of full pixel 192 comprises four pulse width modulation base time is 190 and is therefore 200 μs. Print head 50 moves with a velocity of 500 mm/s such that the length of full pixel 192*a* which corresponds to the time of full pixel 192 is 100 μm. The printed full pixel 192*b* is also 100 μm. The phase shifts of the starting time of the laser pulses of ⅙×50 μs result in a corresponding shift in the generated pixels 181, 182 . . . . The maximum error 195 or the maximum shift between the first generated pixel 181 and the ninth generated pixel 189 is ⅝×25 μm. Phase shifting of the pulses does have the effect that the electrical current or power which is needed to drive the lasers 115 or laser modules is smoothed. There is no time between two pulses in which no laser light is emitted as in the embodiment shown in FIG. 11. Eight laser pixels of the group of laser pixels are driven at the same time at nominal electrical power. Therefore on average ⅙ less electrical energy is needed to drive the group of laser pixels and the drive current is essentially constant in comparison to the embodiment shown in FIG. 11.

FIG. 13 shows a principal sketch of a third PWM driving scheme. The third PWM driving scheme is adapted to a laser printing system 100 comprising a controller 10 which is adapted such that at maximum processing speed of print head 50 of 500 mm/s only two laser pixel or modules of a group of nine laser pixels or modules can be driven at nominal electrical power. Print head 50 comprises a multitude of such group of laser pixels or modules. The pulses of the different laser pixels 171, 172, . . . 179 of the group of laser pixels which comprises in this case 9 laser pixels are phase shifted ⅛ of pulse width 191 with respect to each other (or ⅑ of the pulse width modulation base time 190). The pulse width modulation base time 190 is in this case 50 μs. The pulse width 191 is ⅔ of the pulse width modulation base time 190 such that only two of the laser pixels 171, 172 . . . , 179 are driven at the same time. The time of full pixel 192 comprises 16 pulse width modulation base times 190 and is therefore 800 μs. Print head 50 moves with a reduced velocity of 500/4 mm/s such that the length of full pixel 192*a* which corresponds to the time of full pixel 192 is again 100 μm. The printed full pixel 192*b* is also 100 μm. The phase shifts of the starting time of the laser pulses of ⅑×50 μs result in a corresponding shift in the generated pixels 181, 182 . . . . The maximum error 195 or the maximum shift between the first generated pixel 181 and the ninth generated pixel 189 is ⅝×6.25 μm. The third PWM driving scheme enables printing of complete layers within the working plane 80 at reduced electrical input power and printing velocity. There may be non-linear effects (e.g. caused by heat dissipation) depending on the material and the particle which is used to print the object 70. It may be necessary to adapt the driving scheme in accordance with these non-linear effects. Visibility of printing errors at the edges of an object 70 may be reduced by avoiding systematic and especially regular phase shifts between the pixels as shown in FIG. 13. Applying random phase shifts to the pulses under the boundary condition that only two laser pixels 171, 172 . . . , 179 emit laser light during printing may help to reduce visibility of such systematic printing errors FIG. 14 shows a principal sketch of a fourth PWM driving scheme. The fourth PWM driving scheme is adapted to a laser printing system 100 comprising a controller 10 which is adapted such that at maximum processing speed of print head 50 of 500 mm/s only one laser pixel or module of a group of four laser pixels or modules can be driven at nominal electrical power. Print head 50 comprises a multitude of such group of laser pixels or modules. The pulses of the different laser pixels 171, 172, 173, 174 of the group of laser pixels which comprises in this case 4 laser pixels are phase shifted ¼ pulse width modulation base time 190 with respect to each other. The pulse width modulation base time 190 is in this case 200 μs. The pulse width 191 is ⅔ of the pulse width modulation base time 190 such that only one of the laser pixel 171, 172, 173, 174 is driven at one moment in time. The time of full pixel 192 comprises four pulse width modulation base times 190 and is therefore 800 μs. Print head 50 moves with a reduced velocity of 500/4 mm/s such that the length of full pixel 192*a* which corresponds to the time of full pixel 192 is 100 μm. The printed full pixel 192*b* is also 100 μm. The phase shifts of the starting time of the laser pulses of ¼×200 μs result in a corresponding shift in the generated pixels 181, 182, 183, 184. The maximum error 195 or the maximum shift between the first generated pixel 181 and the fourth generated pixel 189 is 18.75 μm. The fourth PWM driving scheme enables printing of complete layers within the working plane 80 at reduced electrical input power and printing velocity.

The description especially provided with respect to FIG. 13 and FIG. 14 applies to lasers 115 within a laser module or to laser modules within a group of laser modules. The driving schemes can be modified, for example, by means of buffer capacitors which enable to drive in extreme case all laser modules at the same time for a short period of time. There is a multitude of possible variations of the pulse width modulation base time 190, the pulse width 191, the phase shifts between the laser pulses, the pulse amplitude or, for example, the shape of the laser pulses which can be combined with a multitude of possible arrangements of groups of lasers or laser modules which are supplied by one electrical power supply 20.

FIG. 15 shows a principal sketch of method steps of a method of laser printing. An object 70 in a working plane 80 is moved relative to a print head 50 in step 210. The print head 50 comprises a total number of laser modules 150. At least two of the laser modules 150 share an electrical power supply 20. In step 220 is laser light emitted by means of the laser modules 150. The laser module comprises at least one laser array 110 of lasers 115. The laser modules 150 are controlled in step 230 such that at maximum processing speed of the print head 50 only a predefined number of laser modules 150 can be driven at nominal electrical power wherein the predefined number of laser modules 150 is smaller than the total number of laser modules 150.

It is a basic idea of the embodiments presented above to reduce the maximum electrical input power which can be provided to the lasers despite of the fact that the lasers can be driven in parallel at nominal power. This has the consequence that either a part of the lasers has to be switched off or the power emitted by the lasers is reduced if more than a predefined number of laser modules has to be driven at nominal power in order to process a given structure at maximum processing speed. Both have the consequence that the overall production time increases. This consequence is acceptable in view of the fact that usually at 80% of the production time only 10% to 20% of the lasers are driven at nominal electrical power. The reduction in processing speed is thus limited to the 20% in which more than, for example, 20% are activated in parallel. The total reduction in processing speed is small but the reduction with respect to the complexity of the print head and the power supply of laser modules is significant.

To maximize the usefulness of the power reduction strategy some modifications in the electrical system may be necessary. External power supply have to be shared over sufficiently large number of laser modules. The number of laser modules depends on the configuration which is used in order to limit the electrical input power which is provided or supplied to the lasers. It may be sufficient to supply a group of laser modules as for example a diagonal column or row as described above by means of one electrical power supply. In other configurations it may be beneficial to supply all laser modules with one electrical power supply. Sharing of external power supplies has the effect that the supply current remains limited even if larger structures in some area are sintered. The reduced peak power required still keeps dimensions of current distribution acceptable. Furthermore, it may be beneficial to allow control modulation with shifted PWM. Shifted PWM may be especially implemented by control of PWM in terms of pulse length and phase. Commercially available controllers are configured to enable control by means of shifted PWM.

While the invention has been illustrated and described in detail in the drawings and the foregoing description, such illustration and description are to be considered illustrative or exemplary and not restrictive.

From reading the present disclosure, other modifications will be apparent to persons skilled in the art. Such modifications may involve other features which are already known in the art and which may be used instead of or in addition to features already described herein.

Variations to the disclosed embodiments can be understood and effected by those skilled in the art, from a study of the drawings, the disclosure and the appended claims. In the claims, the word "comprising" does not exclude other elements or steps, and the indefinite article "a" or "an" does not exclude a plurality of elements or steps. The mere fact that certain measures are recited in mutually different dependent claims does not indicate that a combination of these measures cannot be used to advantage.

Any reference signs in the claims should not be construed as limiting the scope thereof.

LIST OF REFERENCE NUMERALS

10 controller
12 data input
14 power input
20 electrical power supply
22 main data input
24 main power input
25 filter (comprises buffer capacitor(s) for providing power)
30 object carrier
40 frame
50 print head
52 print carrier
70 object
80 working plane
82 working area
100 laser printing system
110 laser array
115 laser
120 laser driver
122 DC/DC converter
124 signal isolation
126 PWM current source
150 laser module
160 group of laser modules
171 first laser pixel
171*a* energy of first pixel on target material
172 second laser pixel
173 third laser pixel
174 fourth laser pixel
179 ninth laser pixel
181 generated first pixel
182 generated second pixel
183 generated third pixel
184 generated fourth pixel
188 generated ninth pixel
190 pulse width modulation base time
191 pulse width
192 time of full pixel
192*a* length of full pixel
192*b* printed full pixel
195 maximum error
210 step of moving
220 step of emitting laser light
230 step of controlling

The invention claimed is:

1. A laser printing system comprising:

a print head, the print head comprising a plurality of laser modules, wherein each laser module comprises at least one laser array of lasers, wherein at least two of the laser modules share an electrical power supply; and a controller circuit, wherein the controller circuit is arranged such that at maximum processing speed of the print head only a predefined number of laser modules can be driven at nominal electrical power, wherein the predefined number of laser modules is a portion of the plurality of laser modules, wherein the controller circuit is arranged to reduce a processing speed of the print head if the optical energy to be provided to the object within a predefined time period requires an electrical input power exceeding the nominal electrical power of the laser modules times the predefined number of laser modules, wherein the controller circuit is arranged to reduce an electrical input power supplied to the laser modules below the nominal electrical power of the laser modules when the processing speed is lower than the maximum processing speed such that emission of laser light by more than the predefined number of laser modules is enabled, wherein the laser printing system illuminates an object in a working plane, wherein the object is moving relative to the print head.

2. The laser printing system according to claim 1, wherein the controller circuit is arranged to control the laser modules with shifted pulse width modulation, wherein the shifted pulse width modulation has a pulse width modulation base time, a pulse width and a pulse phase.

3. The laser printing system according to claim 2, wherein the laser modules and/or the electrical power supply comprise buffer capacitors, wherein the buffer capacitors are arranged to store energy to supply electrical power to the laser modules such that more than the predefined number of laser modules can be driven at nominal electrical power for a predefined period of time.

4. The laser printing system according to claim 2, wherein the laser modules are arranged in columns, wherein one electrical power supply is arranged to supply electrical power to all laser modules of one column, wherein the controller circuit is arranged to adapt the pulse width modulation base time such that the distance of the laser pulses received on the object remains constant, wherein the controller circuit is arranged to keep the pulse width of the lasers constant, wherein the controller circuit is arranged such that a reduction of electrical power supplied to the laser modules is adapted to a reduction of the processing speed at a constant printing resolution.

5. The laser printing system according to claim 2, wherein the laser modules are arranged in columns, wherein one electrical power supply is arranged to supply electrical power to all laser modules of one column, wherein the controller circuit is arranged to to supply interleaving pulse width modulation pulses at a constant pulse width modulation base time to the lasers of the column such that the drive current supplied by the electrical power supply open is smoothed.

6. The laser printing system according to claim 5, wherein the controller circuit is arranged to start pulses with a defined pulse width, wherein the different times of starting the pulses are distributed across the pulse width modulation base time.

7. The laser printing system according to claim 6, wherein the different times of starting the pulses are randomly distributed.

8. The laser printing system according to claim 5, wherein the controller circuit is arranged to start pulses provided to the lasers of different laser modules at different times during the pulse width modulation base time, wherein the different times of starting the pulses are distributed across the pulse width modulation base time.

9. The laser printing system according to claim 3, wherein the laser modules being arranged in columns, wherein one electrical power supply is arranged to supply electrical power to all laser modules of a least two columns, wherein the at least two columns comprise a common buffer capacitance, wherein the controller circuit is arranged to supply interleaving pulse width modulation pulses at constant pulse width modulation time to the lasers of the at least two columns such that the drive current supplied by the electrical power supply is smoothed.

10. The laser printing system according to claim 2, wherein the controller circuit is arranged to adapt the pulse width modulation base time such that the distance between laser pulses received on the object remains constant, wherein the controller circuit is arranged to adapt the pulse width of the lasers such that a part of a reduction of electrical power supplied to the laser modules is caused by a shortened pulse width.

11. The laser printing system according to claim 2, wherein the controller circuit is arranged to keep the pulse width modulation base time constant, wherein the controller circuit is arranged to keep the pulse width of the lasers constant, wherein the controller circuit is arranged to skip pulses in accordance with a reduction of the processing speed.

12. The laser printing system according to claim 1, wherein all laser modules of a group of laser modules share the electrical power supply, wherein the controller circuit is arranged to switch off at least one laser module of the group of laser modules if the optical energy to be provided to the object within a predefined time period requires an electrical input power exceeding the nominal electrical power of the laser modules times the predefined number of laser modules, wherein the controller circuit is arranged to switch off the at least one laser module such that a full width of the print head can be processed within at least two passes of the print head across the object.

13. A method of laser printing, the method comprising:

moving an object in a working plane relative to a print head, the print head comprising a plurality of laser modules, wherein at least two of the laser modules share an electrical power supply;

emitting laser light using the laser modules, the laser modules comprising at least one laser array of lasers;

controlling the laser modules such that at maximum processing speed of the print head only predefined number of laser modules can be driven at nominal electrical power, wherein the predefined number of laser modules is a portion of the plurality of laser modules;

reducing a processing speed of the print head if the optical energy to be provided to the object within a predefined time period requires an electrical input power exceeding the nominal electrical power of the laser modules times the predefined number of laser modules; and reducing an electrical input power supplied to the laser modules below the nominal electrical power of the laser modules when the processing speed is lower than the maximum processing speed such that emission of laser light by means of more than the predefined number of laser modules at the same time for seamless printing is enabled.

14. The method according to claim 13, wherein the controlling uses shifted pulse width modulation.

15. The method according to claim 14, wherein the shifted pulse width modulation has a pulse width modulation base time, a pulse width and a pulse phase.

16. The method according to claim 15, wherein the laser modules are arranged in columns, wherein one electrical power supply is arranged to supply electrical power to all laser modules of one column, wherein the controlling is arranged to adapt the pulse width modulation base time such that the distance of the laser pulses received on the object remains constant, wherein the controlling is arranged to keep the pulse width of the lasers constant, wherein the controlling is arranged such that a reduction of electrical power supplied to the laser modules is adapted to a reduction of the processing speed at a constant printing resolution.

17. The method according to claim 15, wherein the laser modules are arranged in columns, wherein one electrical power supply is arranged to supply electrical power to all laser modules of one column, wherein the controlling is arranged to supply interleaving pulse width modulation pulses at a constant pulse width modulation base time to the lasers of the column such that the drive current supplied by the electrical power supply open is smoothed.

18. The method according to claim 17, wherein the controller circuit is arranged to start pulses with a defined pulse width, wherein the different times of starting the pulses are distributed across the pulse width modulation base time.

19. The method according to claim 18, wherein the different times of starting the pulses are randomly distributed.

20. The method according to claim 13, wherein all laser modules of a group of laser modules share the electrical power supply, wherein the controlling is arranged to switch off at least one laser module of the group of laser modules if the optical energy to be provided to the object within a predefined time period requires an electrical input power exceeding the nominal electrical power of the laser modules times the predefined number of laser modules, wherein the controlling is arranged to switch off the at least one laser module such that a full width of the print head can be processed within at least two passes of the print head across the object.

* * * * *